US008616180B2

(12) United States Patent
Spitler et al.

(10) Patent No.: US 8,616,180 B2
(45) Date of Patent: Dec. 31, 2013

(54) AUTOMATIC IDLE SYSTEMS AND METHODS

(75) Inventors: Charles R. Spitler, Haw River, NC (US); Tyler Ricketts, West Mansfield, OH (US); Nathaniel Lenfert, Graham, NC (US); Andrew E. Bejcek, Mebane, NC (US); Yasushi Fujita, Chapel Hill, NC (US)

(73) Assignee: Honda Motor Co., Ltd., Tokyo (JP)

( * ) Notice: Subject to any disclaimer, the term of this patent is extended or adjusted under 35 U.S.C. 154(b) by 1167 days.

(21) Appl. No.: 12/500,320

(22) Filed: Jul. 9, 2009

(65) Prior Publication Data

US 2011/0005024 A1 Jan. 13, 2011

(51) Int. Cl.
*F02D 41/00* (2006.01)

(52) U.S. Cl.
USPC ..... 123/339.1; 123/339.16

(58) Field of Classification Search
USPC ..... 123/339.1, 339.16, 376, 389, 399–401, 123/319
See application file for complete search history.

(56) References Cited

U.S. PATENT DOCUMENTS 2,009,659 A 7/1935 Hill et al.
2,134,889 A * 11/1938 Phillips ..... 123/344
2,529,437 A 11/1950 Weinberger
3,276,439 A 10/1966 Reichenbach
3,502,167 A * 3/1970 Baxter et al. ..... 180/175
4,884,541 A 12/1989 Marriott
5,069,180 A 12/1991 Schmidt et al.
5,186,142 A 2/1993 Brunelli et al.
6,729,298 B1 * 5/2004 Sterr ..... 123/339.13
6,971,369 B1 12/2005 Mitchell et al.
6,983,736 B2 1/2006 Mitchell et al.
7,246,794 B2 * 7/2007 Suzuki et al. ..... 261/52
7,318,407 B1 * 1/2008 Klonis et al. ..... 123/376
7,343,898 B1 * 3/2008 Caldwell et al. ..... 123/376
7,886,716 B1 * 2/2011 Arai et al. ..... 123/400
7,950,366 B2 * 5/2011 Arai et al. ..... 123/376

(Continued)

OTHER PUBLICATIONS

International Search Report and Written Opinion for PCT/US2010/041174 dated Aug. 31, 2010.

(Continued)

*Primary Examiner* — John T. Kwon
*Assistant Examiner* — Johnny Hoang
(74) *Attorney, Agent, or Firm* — Jenkins, Wilson, Taylor & Hunt, P.A.

(57) ABSTRACT

The present subject matter relates to arrangements and uses for engine speed governors. In particular, an automatic idle system for a small engine can include an engine speed governor for connection to a small engine with a governor shaft rotatable in response to a speed of the engine. A governor linkage can include a first portion for connection to the governor shaft and a second portion for connection to a throttle control of the engine, the first portion being movably connected with or to the second portion. An actuator can be connected to the second portion of the governor linkage, the actuator being movable in response to a load on the engine to move the second portion relative to the first portion. In this configuration, when the engine is in a low-load state, the second portion can be moved relative to the first portion toward a throttle-closed position.

21 Claims, 6 Drawing Sheets

(56) References Cited

U.S. PATENT DOCUMENTS

| | | | | |
|---|---|---|---|---|
| 2003/0196638 | A1 | 10/2003 | Matsuda et al. | |
| 2005/0155573 | A1* | 7/2005 | McLeod | 123/376 |
| 2006/0130808 | A1* | 6/2006 | Steffes et al. | 123/376 |
| 2007/0186899 | A1* | 8/2007 | Nishimura et al. | 123/364 |
| 2007/0273152 | A1* | 11/2007 | Kawakami et al. | 290/17 |
| 2008/0014096 | A1 | 1/2008 | Gilpatrick | |
| 2011/0005024 | A1* | 1/2011 | Spitler et al. | 15/320 |

OTHER PUBLICATIONS

Communicaton of European publication number and information on the application of Article 67(3) EPC for Application Serial No. EP 10797764.7 dated Apr. 18, 2012.

European Search Report for Application Serial No. EP 10797764.7 dated Jun. 8, 2012.

European Office Action for App. Serial No. EP 10797764.7 dated Aug. 10, 2012.

* cited by examiner

AUTOMATIC IDLE SYSTEMS AND METHODS

TECHNICAL FIELD

The subject matter disclosed herein relates generally to speed regulating systems for small engines. More particularly, the subject matter disclosed herein relates to arrangements and uses for engine speed governors.

BACKGROUND

Small combustion engines can be used in a wide variety of power equipment. For instance, a pressure washer, log splitter, lawnmower, air compressor, generator or the like can use an internal combustion engine to power a working component (e.g., a high pressure water pump, hydraulic pump, cutting blade). In typical pressure washers, a speed regulation system can be provided for maintaining the engine speed within a governed speed range. Referring to FIG. 1, a typical speed regulation system can include a pivoting or fixed governor arm 110 that is rotationally coupled to a rotatable shaft of a centrifugal or air vane/foil governor device coupled to an engine. Pivoting or fixed governor arm 110 can connect the centrifugal device to a throttle control TC of the engine. Specifically, a governor rod 112 can connect pivoting governor arm 110 to throttle control TC. In addition, a governor rod spring 114 can be provided to dampen fluctuations in the position of governor arm 110 caused by small variations in the engine speed. Governor arm 110 can further be connected to a fixed frame element 120 by a governor spring 116 for helping to return governor arm 110 to its initial position once the engine speed is reduced.

In this common configuration, as the speed of the engine increases, a moment is generated on the rotatable shaft of the centrifugal device, which in turn causes the rotation of governor arm 110. This rotation moves governor rod 112 to move throttle control TC toward a closed position. In this way, the speed regulation system maintains the engine speed within a predefined governed speed range.

The particular governed speed range can be set by adjusting the tension on governor spring 116. For instance, this adjustment can typically involve bending the portion of governor arm 110 that is connected to governor spring 116 or changing the spring mount on frame element 120. This adjustment is usually only made at the time of manufacture or while the engine is being serviced. As a result, in order to achieve the best possible performance, equipment manufacturers tend to set the governed speed range to a relatively high engine speed to maximize the pump flow, pressure, cutting performance, or other performance characteristic. Because the governor speed range is not easily adjustable, the engine runs in this high speed range regardless of whether or not the pump or blade is doing work.

With regard to pumps in particular, this single governed speed range can be problematic due to the fact that pumps generally exhibit two basic engine load scenarios. In a first mode, a valve is actuated to allow the pump to pressurize and flow fluid and do work. In this condition, the pump is applying a very high load to the engine. In a second mode, the valve is not actuated, which does not allow the pump to flow water or do any net work. In this condition, the pump is applying a very light load to the engine. As a result, typical use involves a significant amount of time where the valve is not being actuated and the pump is not doing work. Accordingly, there are several problems that exist because the engine runs at a high speed even in its unloaded state (i.e., when the valve is not being actuated), including high levels of noise emitted from the engine, reductions in pump life and engine life by running at a high speed, and higher fuel consumption than it would be at a lower speed.

Accordingly, it would be advantageous for a small power machine such as a pressure washer, log splitter, lawnmower, air compressor, generator or the like to include a control system that can achieve a large automatic reduction in engine idling speed without requiring any additional system integration, such as a water pressure control line tied into the pressure washer pump. At the same time, it is further advantageous that the engine still responds quickly (i.e., resumes high speed operation) when a load is applied.

SUMMARY

In accordance with this disclosure, arrangements and uses for engine speed governors are provided. In one aspect, an automatic idle system for a small engine is provided. The automatic idle system can include an engine speed governor for connection to a small engine. The governor can include a governor shaft rotatable in response to a speed of the engine. A governor linkage or fixed governor arm can include a first portion for connection to the governor shaft and a second portion for connection to a throttle control of the engine, and the first portion can be movably connected with the second portion, such as by the first portion being pivotably coupled to the second portion. An actuator can be connected to the second portion of the governor linkage, the actuator being movable in response to a load on the engine to move the second portion relative to the first portion from a base position to an adjusted position. In this configuration, when the engine is in a low-load state, the second portion can be moved such as by pivoting relative to the first portion toward a throttle-closed position.

In another aspect, a pressure washer is provided. The pressure washer can include an engine drivingly engaged to a pump, an engine speed governor coupled to the engine, a governor linkage connecting the engine speed governor to a throttle control of the engine, and an actuator. The engine can include an adjustable throttle and a switch or valve movable between an ON position in which water is allowed to flow from the pump and an OFF position in which water is prevented from flowing from the pump. The governor can include a governor shaft rotatable in response to a speed of the engine, and the governor linkage can include a first portion connected to the governor shaft and a second portion connected to a throttle control of the engine. The first portion can be movably connected with, such as by a pivotably coupled connection, the second portion, and the actuator can be connected to the second portion of the governor linkage, the actuator being movable in response to a load on the engine to move, such as pivoting, the second portion relative to the first portion from a base position to an adjusted position. As a result, when the switch is in the off position, the second portion can be moved, such as by pivoting, relative to the first portion toward a throttle-closed position.

In yet another aspect, a method for automatically adjusting the speed of an engine is provided. The method can include coupling an engine speed governor to a small engine, the governor comprising a governor shaft rotatable in response to a speed of the engine. The method can further include connecting a governor linkage between the governor shaft and a throttle control of the engine, with the governor linkage comprising a first portion connected to the governor shaft and a second portion connected to the throttle control, and the first portion being movably connected with, such as by being pivotably coupled with or to the second portion. The method can also include moving an actuator in response to a load on the engine to move the second portion relative to the first portion from a base position to an adjusted position. In this way, when the engine is in a low-load state, the second portion is moved relative to the first portion toward a throttle-closed position.

Some of the objects of the subject matter disclosed herein having been stated hereinabove, and which are achieved in whole or in part by the presently disclosed subject matter, other objects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely byway of explanatory and non-limiting example, and in which.

DETAILED DESCRIPTION

Figure 1:
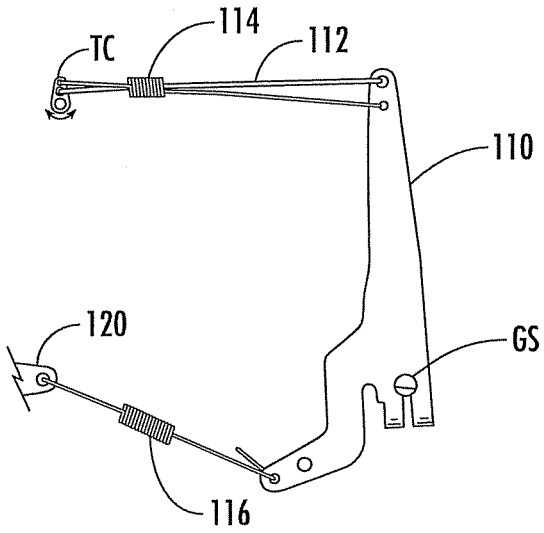
FIG. 1 (PRIOR ART)
FIG. 1 is a side view of a movable governor arm according to a typical embodiment of a prior art speed regulation system.
Figure 2:
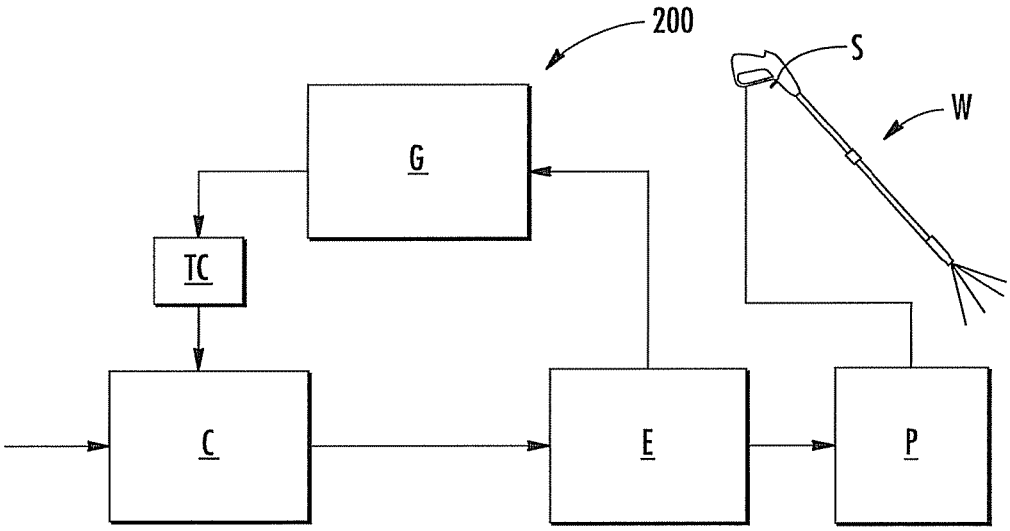
FIG. 2 is a schematic diagram of the interconnection of components in an automatic low speed idle system according to an embodiment of the presently disclosed subject matter.

The present subject matter provides automatic low speed idle systems and methods for small engines. In one aspect, the present subject matter provides a system that is designed to automatically lower the engine speed below the governed speed range when the engine is in a low-load state (i.e., when a pressure washer trigger is not pulled). In particular, referring to FIG. 2, a small engine E can generally include a carburetor C that can be located in the intake tract of engine E, and carburetor C can include a throttle control TC for controlling the delivery of the fuel/air mixture from carburetor C to engine E. In one particular embodiment, for example, engine E can be configured to drive a pressure washer system. In particular, engine can drive a water pump P, which can be connected to a nozzle-containing wand W. A user can actuate a switch or valve S, such as a trigger on wand W, that can be moved to an ON position to engage pump P and initiate the flow of water. When switch S is moved to an OFF position (e.g., trigger is released), pump P can be disengaged and the flow of water stopped. Alternatively, movement of switch S to a disengaged position can activate a low-pressure bypass circuit to stop the flow of water and lower the engine load.

Figure 3A:
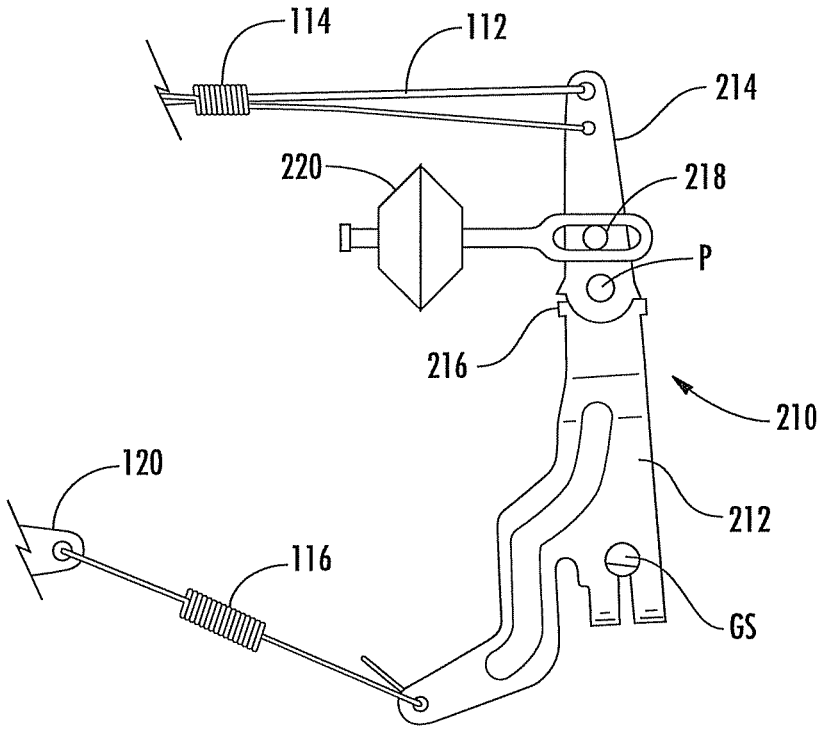
FIGS. 3A through 3C are side views of a multi-piece governor linkage in three different operating positions according to an embodiment of the presently disclosed subject matter.
Figure 3B:
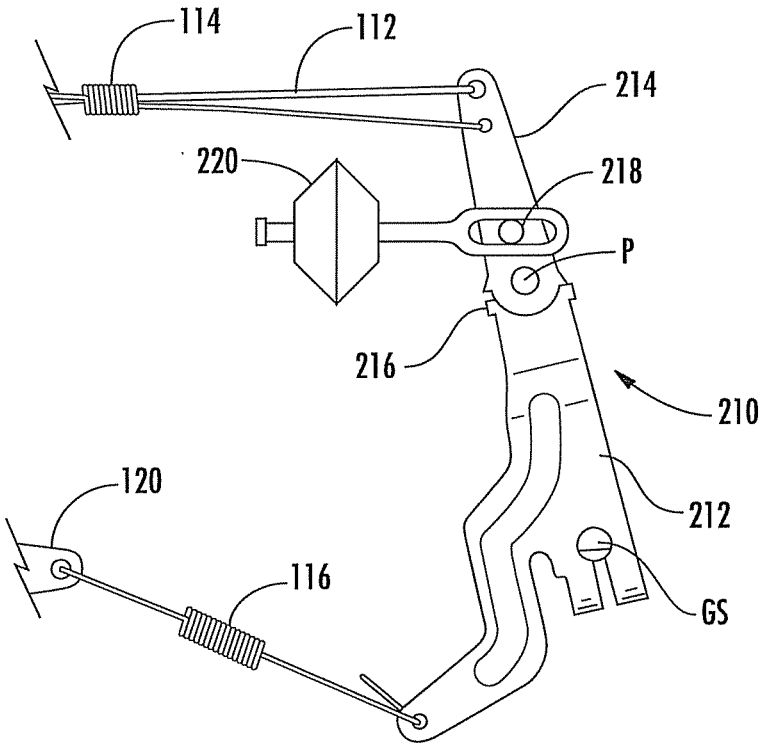
Figure 3C:
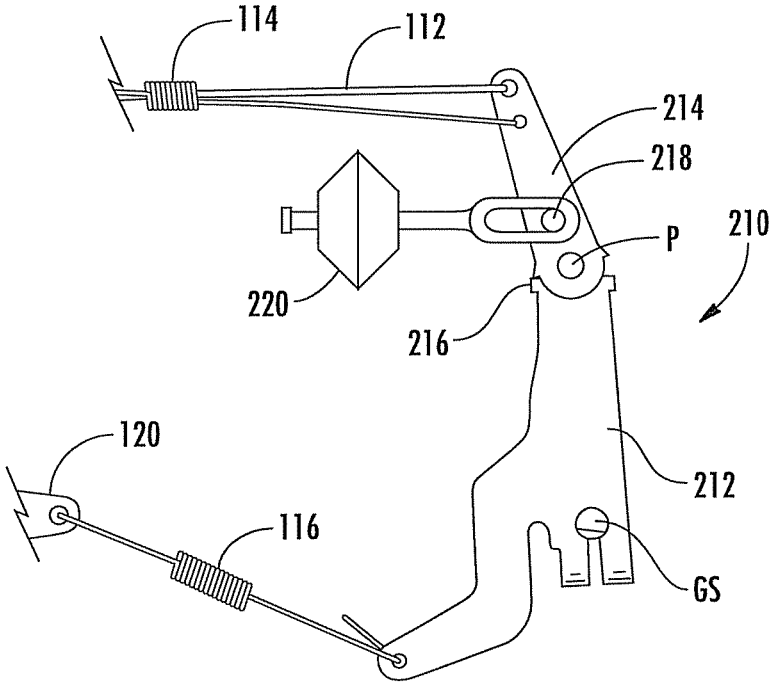

Regardless of the specific use of small engine E, an automatic idle system, generally designated 200, can include an engine speed governor G coupled to engine E. Referring to the particular configuration illustrated in FIGS. 3A through 3C, governor G can have a governor shaft GS rotatable in response to a speed of engine E. A governor linkage, generally designated 210 can be used in place of governor arm 110 of the conventional speed regulation system. Governor linkage 210 can thus be integrated into a speed regulation system having many of the same components as the conventional system, including a governor rod 112 and governor spring 114 connecting governor linkage 210 to throttle control TC, and a governor spring 116 connected to a fixed frame element 120.

Where governor linkage 210 can differ from conventional governor arm 110 is that governor linkage 210 can be a multi-piece component. In particular, governor linkage 210 can include a first portion 212 connected to governor shaft GS and a second portion 214 connected to a throttle control TC of engine E. First portion 212 can be movably connected with, such as by being pivotably coupled to, second portion 214 at a pivot point P.

Despite governor linkage 210 comprising multiple pieces rather than a single governor arm, governor linkage 210 can function in a substantially similar manner to the conventional governor arm under loaded conditions. Specifically, when the speed of engine E is relatively low, governor linkage 210 can be in a base position (e.g., "straight" position) shown in FIG. 3A, for instance due to the mount position of governor spring 114 with respect to carburetor C tending to rotate second portion 214 of governor linkage 210 clockwise. Governor linkage 210 can further include a stop to prevent second portion 214 from rotating past this base position. When the engine speed increases, governor shaft GS can be rotated, causing governor linkage 210 to move toward a throttle-closing position shown in FIG. 3B, which is similar to the operation of a conventional governor arm.

The multi-piece configuration of governor linkage 210 provides additional functionality, however, by adjusting the position of throttle control TC depending on the load on the engine as well as on the speed of the engine. To accomplish this load-based adjustment, an actuator 220 can be connected to second portion 214 of governor linkage 210. Actuator 220 can be movable in response to a load on engine E to move, such as by pivoting, second portion 214 relative to first portion 212 from the base position to an adjusted position. Specifically, when the engine is in a low-load state, actuator 220 can move second portion 214 to the adjusted position in which second portion 214 is moved or pivoted relative to first portion 212 to move throttle control TC toward a throttle-closed position.

Once a load is placed on the engine, actuator 220 can allow second portion 214 to move back so that governor linkage 210 is again in the base position. In addition, governor linkage 210 can further include a rigid stop 216 to prevent second portion 214 from moving further than a maximum desired rotation to limit the amount that the operation of actuator 220 can affect the adjustment of throttle control TC. Governor linkage can also include a biasing mechanism, such as a spring, which can bias second portion 214 toward the base position. In addition, actuator 220 can be designed so that the operation of engine governor G and the vacuum characteristics of engine E are able to overcome the force applied by actuator 220 without a substantial decrease in the engine speed after the engine encounters a load. In this way, automatic idle system 200 allows engine E to respond quickly to the load condition.

Figure 4:
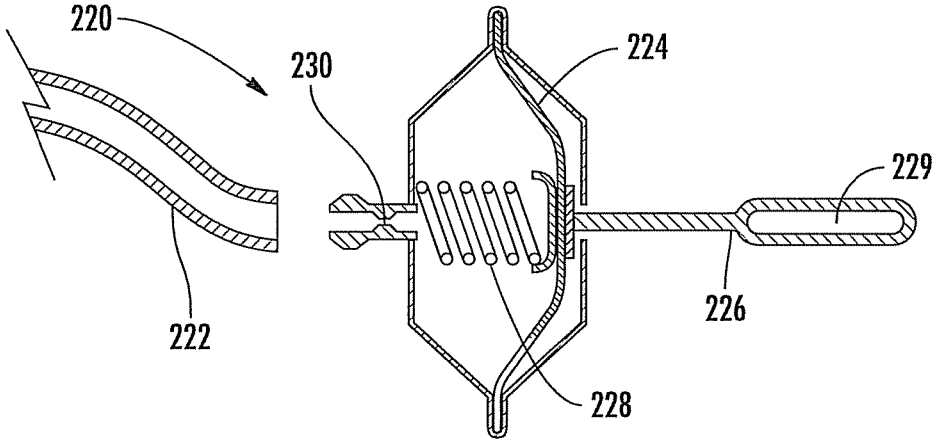
FIG. 4 is a sectional side view of a vacuum actuator for use with an automatic idle system according to an embodiment of the presently disclosed subject matter.

In one particular embodiment, actuator 220 can be a vacuum actuator in communication with carburetor C of engine E. Specifically, referring to FIG. 4, actuator 220 can be connected by flexible tubing 222 to a passage in an intake system vacuum source, such as a carburetor insulator CI in communication with an intake tract between throttle control TC and an engine intake valve. A restriction 230 can be located in the passage or in actuator 220 itself to minimize the pulsation effect caused by unsteady flow in the intake tract. Actuator 220 can include a diaphragm 224 movable in response to pressure in carburetor C and an actuation rod 226 having a first end attached to diaphragm 224 and a second end coupled to second portion 214 (shown in FIGS. 3A-3C) of governor linkage 210.

Figure 5A:
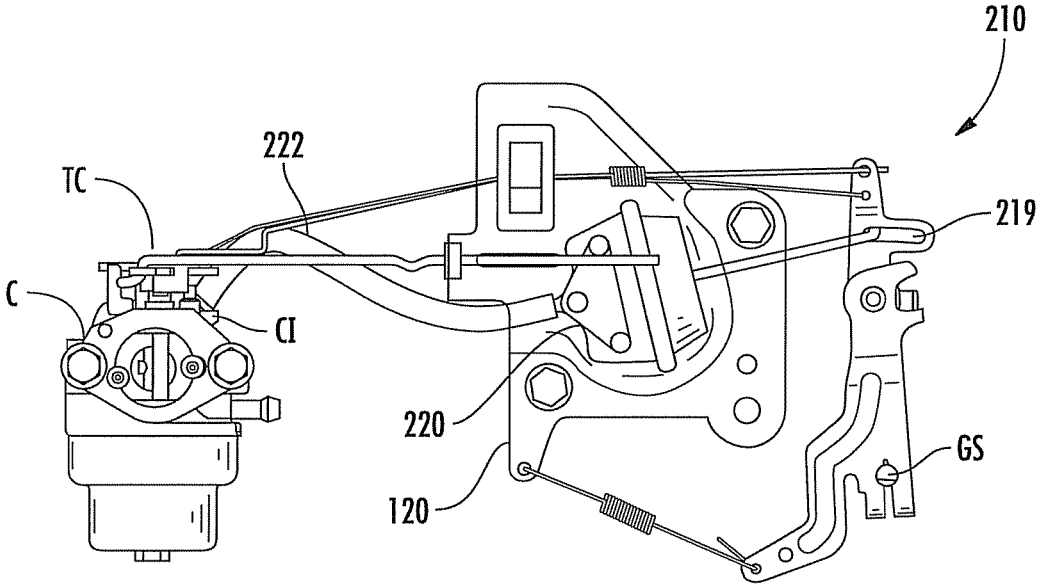
FIGS. 5A and 5B are side views of an automatic idle system in two different operating positions according to an embodiment of the presently disclosed subject matter.

For instance, second portion 214 can have a raised feature 218 (shown in FIGS. 3A-3C) to which an actuator slot 229 on the second end of actuation rod 226 can be coupled. Alternatively, second portion 214 can have a linkage slot 219 (shown in FIGS. 5A and 5B) into which the second end of actuation rod 226 can be coupled. In either configuration, movement of actuation rod 226 can cause the movement of second portion 214 relative to first portion 212, but any movement of governor linkage 210 in response to changes in the engine speed will not necessarily be transferred to actuator 220 because of either of linkage slot 219 or actuator slot 229.

Figure 5B:
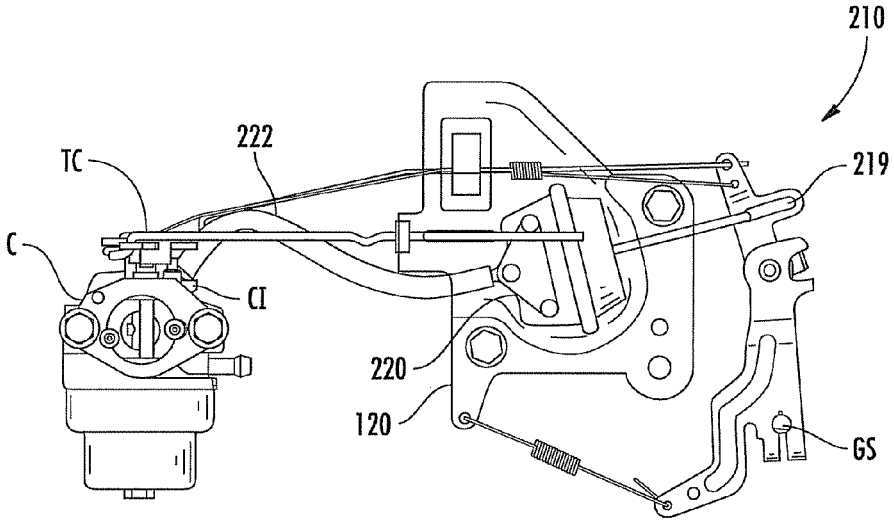

Regardless of the specific configuration, actuator 220 can be thus be connected between carburetor C and governor linkage 210. Referring to the system shown in FIG. 5A, when there is a load on engine E, the pressure in the intake system vacuum source will generally be relatively high. In such a situation, actuator 220 will not exert a force on governor linkage 210, and thus governor linkage 210 can operate in a manner similar to a typical pivoting governor arm. Referring to FIG. 5B, when engine E is in a low-load state, however, the decreased pressure in the intake system vacuum sourcecan cause actuator 220 to exert a force on governor linkage 210. In this way, second portion 214 of governor linkage 210 can be moved from the base position to an adjusted position, which in turn moves throttle control TC toward a throttle-closed position.

Figure 6:
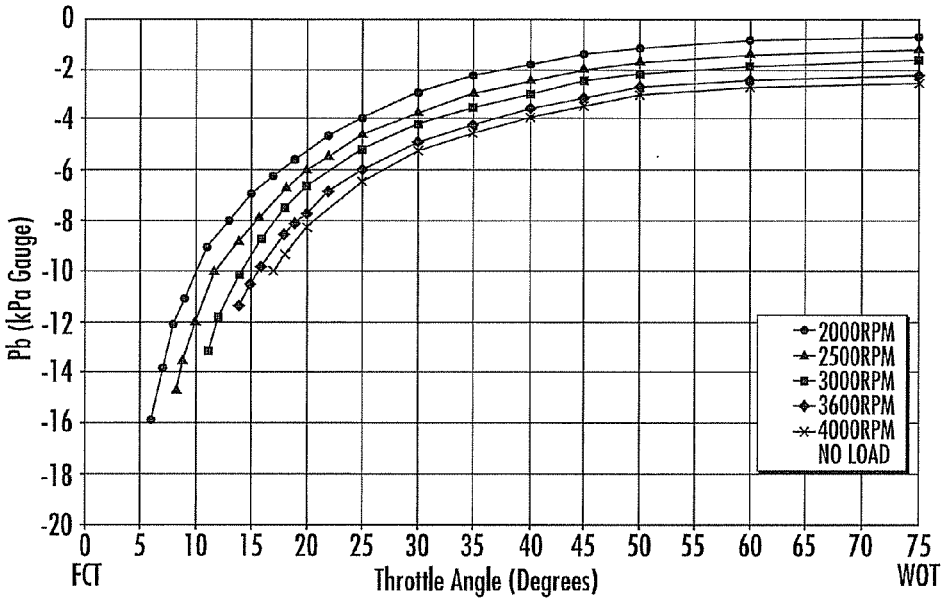
FIG. 6 is a graph showing average intake tract pressure as a function of engine speed and throttle angle.

In this arrangement, the engine's natural vacuum characteristics can move actuator 220 to the appropriate position depending on whether engine E should run in the high governed speed range or in the low speed idle state. For instance, FIG. 6 shows the average intake tract pressure as a function of engine speed and throttle angle. Throttle angle can be related to engine torque, and although it is not a linear relationship, generally a greater throttle angle indicates a greater engine torque. As a result, it can be understood that average engine intake tract pressure decreases with decreasing load.

Therefore, as discussed above, actuator 220 can be designed such that at high loads, when the intake tract pressure can be relatively close to atmospheric pressure, actuator 220 can move actuation rod 226 to be in an extended position. Further, actuator 220 can have an internal spring, generally designated 228, that applies a force on diaphragm 224 to return actuation rod 226 to its extended position when the internal pressure is above a certain level. Conversely, at low loads, the relatively low intake tract pressure causes actuator 220 to move actuation rod 226 to a retracted position.

With a configuration such as described above, the system can operate as follows. When engine E is running at a high load, the intake tract pressure can be high enough that actuation rod 226 of actuator 220 can be in its extended position, allowing the governor system to move freely without any effects. Therefore in a high load condition, governor linkage 210 can be both geometrically and functionally the same as it would be on an engine equipped with a conventional governor arm arrangement. This configuration thus causes engine E to run in its typical, relatively high speed range when the engine is loaded (e.g., when the pressure washer trigger is pulled).

When engine E is running at a light load, the intake tract pressure can be low enough that actuation rod 226 of actuator 220 can be in its retracted position. This position causes second portion 214 of governor linkage 210 to move, such as by pivoting, thereby moving throttle control TC to close the carburetor throttle and thereby reduce the engine speed. Additionally, there can be a stop 216 at or near pivot point P so that second portion 214 can only travel a predetermined amount or distance relative to first portion 212. Because of this limitation on the rotation of second portion 214, actuator 220 also applies some tension to governor spring 116 when it is retracted. The net result of these actions can be a relatively low idle speed when the load on engine E is low.

For example, if automatic idle system 200 is incorporated into a pressure washer system, a user actuating a switch S, such as a trigger on a nozzle-containing wand W, can be moved between an ON position in which water is allowed to flow from pump P and an OFF position in which water is prevented from flowing from pump P. In the ON position, the operation of pump P exerts a load on engine E. While this load is applied, automatic idle system 200 can operate in a manner substantially similar to a traditional governor arm. When switch S is released to stop the flow of water, however, the reduction of load on engine E can cause actuator 220 to move second portion 214 of governor linkage 210 so that throttle control TC is moved toward a throttle-closed position. As a result, engine E can automatically idle at a much lower speed when little or no load is applied to the engine. This automatic idle can help to reduce the level of noise emitted from the engine, increase the life of the engine and driven components (e.g., water pump) by reducing the number of revolutions of the engine (per unit time) when little or no load is applied, and decrease the overall fuel consumption of the engine because the engine consumes less fuel when it is idling at lower speeds.

In addition, it is to be understood that the present subject matter is not limited solely to applications to engine-driven pressure washer systems. It is believed that the presently disclosed automatic low-speed idle systems and methods can be used in applications where the engine has two distinct loading scenarios: a high load when the machine is doing work and a very low load when it is not doing work. Some examples include but are not limited to log splitters, lawnmowers with a blade clutch, garden tillers, and portable hydraulic power units.

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. An automatic idle system for a small engine comprising:

an engine speed governor for connection to a small engine, the engine speed governor comprising a governor shaft rotatable in response to a speed of the engine;

a governor linkage comprising a first portion for connection to the governor shaft and a second portion for connection to a throttle control of the engine, the first portion being pivotably coupled to the second portion at a pivot point, wherein the second portion is movable together with the first portion upon rotation of the governor shaft; and an actuator connected to the second portion of the governor linkage, the actuator being movable in response to a load on the engine to pivot the second portion relative to the first portion from a base position to an adjusted position;

wherein when the engine is in a low-load state, the actuator is configured to automatically pivot the second portion relative to the first portion toward a throttle-closed position.

2. The automatic idle system of claim 1, wherein the governor linkage comprises a governor rod and a governor rod spring for connecting the second portion to the throttle control.

3. The automatic idle system of claim 1, wherein the governor linkage comprises a governor spring for connecting the first portion to a fixed frame element.

4. The automatic idle system of claim 1, wherein the governor linkage comprises a biasing mechanism biasing the second portion toward the base position.

5. The automatic idle system of claim 1, wherein the governor linkage comprises a stop that prevents the movement of the second portion relative to the first portion past a maximum amount.

6. The automatic idle system of claim 1, wherein the actuator comprises a vacuum actuator in communication with an intake system vacuum source of the engine.

7. The automatic idle system of claim 6, wherein the vacuum actuator comprises:

a diaphragm movable in response to a pressure in the carburetor;

an actuation rod having a first end attached to the diaphragm and a second end coupled to the second portion of the governor linkage.

8. The automatic idle system of claim 7, wherein the second portion comprises an elongated slot into which the second end of the actuation rod is received.

9. The automatic idle system of claim 7, wherein the actuation rod comprises an elongated slot coupled to a raised feature on the second portion.

10. A pressure washer comprising:

an engine drivingly engaged to a pump, the engine including an adjustable throttle and a switch movable between an ON position in which water is allowed to flow from the pump and an OFF position in which water is prevented from flowing from the pump;

an engine speed governor coupled to the engine, the engine speed governor comprising a governor shaft rotatable in response to a speed of the engine;

a governor linkage comprising a first portion connected to and rotatable with the governor shaft and a second portion connected to a throttle control of the engine, the first portion being pivotably coupled to the second portion at a pivot point, wherein the second portion is movable together with the first portion upon rotation of the governor shaft; and an actuator connected to the second portion of the governor linkage, the actuator being movable in response to a load on the engine to pivot the second portion relative to the first portion from a base position to an adjusted position;

wherein when the switch is in the OFF position, the actuator is configured to automatically pivot the second portion relative to the first portion toward a throttle-closed position.

11. The pressure washer of claim 10, wherein the switch comprises a user-operated trigger mechanism.

12. The pressure washer of claim 10, wherein the governor linkage comprises a governor rod and a governor rod spring connecting the second portion to the throttle control.

13. The pressure washer of claim 10, wherein the governor linkage comprises a governor spring connecting the first portion to a fixed frame element.

14. The pressure washer of claim 10, wherein the governor linkage comprises a biasing mechanism biasing the second portion toward the base position.

15. The pressure washer of claim 10, wherein the actuator comprises a vacuum actuator in communication with a carburetor of the engine.

16. The pressure washer of claim 15, wherein the vacuum actuator comprises:

a diaphragm movable in response to a pressure in the carburetor;

an actuation rod having a first end attached to the diaphragm and a second end coupled to the second portion of the governor linkage.

17. The pressure washer of claim 16, wherein the second portion comprises an elongated slot into which the second end of the actuation rod is received.

18. The pressure washer of claim 16, wherein the actuation rod comprises an elongated slot coupled to a raised feature on the second portion.

19. A method for automatically adjusting the speed of an engine comprising:

coupling an engine speed governor to a small engine, the engine speed governor comprising a governor shaft rotatable in response to a speed of the engine;

connecting a governor linkage between the governor shaft and a throttle control of the engine, the governor linkage comprising a first portion connected to and rotatable with the governor shaft and a second portion connected to the throttle control, the first portion being pivotably coupled to the second portion at a pivot point, wherein the second portion is movable together with the first portion upon rotation of the governor shaft; and moving an actuator in response to a load on the engine to pivot the second portion relative to the first portion from a base position to an adjusted position;

wherein when the engine is in a low-load state, the second portion is automatically pivoted relative to the first portion toward a throttle-closed position.

20. The method of claim 19, wherein moving the actuator comprises moving a vacuum actuator in response to a pressure in the carburetor of the engine.

21. The method of claim 19, further comprising returning the second portion to the base position when a load is applied to the engine.

* * * * *